US008484869B2

(12) United States Patent
Lukas et al.

(10) Patent No.: US 8,484,869 B2
(45) Date of Patent: Jul. 16, 2013

(54) IRONING APPLIANCE COMPRISING A PIEZOELECTRIC PUMP

(75) Inventors: Andrea Lukas, Offenbach (DE); Bjorn Scheve, Reichelsheim (DE); Matthias Hahn, Frankfurt (DE); Franck Mandica, Francheville (FR); Dominique Gelus, Pont-Evêque (FR)

(73) Assignee: Rowenta Werke GmbH, Offenbach (Allemagne) (DE)

( * ) Notice: Subject to any disclaimer, the term of this patent is extended or adjusted under 35 U.S.C. 154(b) by 123 days.

(21) Appl. No.: 13/139,347

(22) PCT Filed: Nov. 30, 2009

(86) PCT No.: PCT/IB2009/007608

§ 371 (c)(1),
(2), (4) Date: Aug. 25, 2011

(87) PCT Pub. No.: WO2010/067158

PCT Pub. Date: Jun. 17, 2010

(65) Prior Publication Data

US 2011/0296723 A1 Dec. 8, 2011

(30) Foreign Application Priority Data

Dec. 11, 2008 (FR) ..... 08 06960

(51) Int. Cl.
*D06F 75/18* (2006.01)
*F04B 17/00* (2006.01)

(52) U.S. Cl.
USPC ..... 38/77.8; 417/413.2

(58) Field of Classification Search
USPC ..... 38/74–77.83; 417/413.2
See application file for complete search history.

(56) References Cited

U.S. PATENT DOCUMENTS

| | | | | | |
|---|---|---|---|---|---|
| 2,222,305 | A * | 11/1940 | Tricomi et al. | 38/77.7 |
| 2,770,896 | A * | 11/1956 | Holmberg | 38/77.1 |
| 5,642,579 | A * | 7/1997 | Netten et al. | 38/77.7 |
| 5,899,675 | A * | 5/1999 | Van Heumen et al. | 417/482 |
| 6,896,193 | B2 * | 5/2005 | Helf et al. | 239/4 |
| 2007/0193076 | A1 * | 8/2007 | Jiang et al. | 38/1 R |
| 2008/0170951 | A1 * | 7/2008 | Satoh | 417/413.2 |
| 2008/0199332 | A1 * | 8/2008 | Satoh et al. | 417/413.2 |
| 2011/0103980 | A1 * | 5/2011 | Mandica | 417/413.2 |

FOREIGN PATENT DOCUMENTS

| | | | |
|---|---|---|---|
| DE | 4304238 | A1 | 8/1994 |
| EP | 0610569 | A1 | 8/1994 |
| FR | 2770856 | A1 | 5/1999 |
| JP | 62142597 | A | 6/1987 |

* cited by examiner

*Primary Examiner* — Ismael Izaguirre
(74) *Attorney, Agent, or Firm* — The Webb Law Firm

(57) ABSTRACT

Provided is an ironing appliance, including a pump that has a pumping chamber provided with an inlet and an outlet, the pumping chamber including a moveable wall having an outer surface contacting a piezoelectric actuator provided to move the movable wall while changing the volume of the pumping chamber by the piezoelectric actuator, wherein the pump is placed in the ironing appliance such that the outlet of the pumping chamber is located at a higher level than the inlet in a normal position for operating the appliance.

12 Claims, 4 Drawing Sheets

IRONING APPLIANCE COMPRISING A PIEZOELECTRIC PUMP

BACKGROUND OF THE INVENTION

1. Field of the Invention

The present invention relates to an ironing appliance comprising a pump that includes a pumping chamber equipped with an inlet and an outlet, the pumping chamber including a movable wall displaceable under the action of a piezoelectric actuator for displacing the membrane in order to aspirate fluid through the inlet and then discharge it through the outlet.

2. Description of Related Art

Japanese patent application #62142597 discloses a clothing iron comprising a piezoelectric pump that supplies a vaporization chamber with water from a receptacle. In this document, the piezoelectric pump is vertically positioned and includes a pumping chamber comprising an inlet and an outlet positioned vertically one above the other, the outlet being located below the inlet.

However, such a piezoelectric pump has the disadvantage of not enabling rapid and easy expulsion of air bubbles introduced in the pumping chamber, for example during no-load operation of the pump in the absence of water in the receptacle. In particular, with such a configuration of the piezoelectric pump, the air bubbles tend to get stuck in the top portion of the pumping chamber and cannot be expelled.

A piezoelectric pump has the disadvantage of having a movable wall with only a very slight clearance such that pump performance is greatly diminished when bubbles are present in the pumping chamber.

SUMMARY OF THE INVENTION

Hence an object of the present invention is to remedy these disadvantages by proposing an ironing appliance in which the piezoelectric pump is configured such that the expulsion of any air bubbles present in the pumping chamber is enabled and good pump performance is obtained, even after no-load operation.

To this end, the object of the invention is an ironing appliance comprising a pump that includes a pumping chamber equipped with an inlet and an outlet, the pumping chamber including a movable wall that comprises an outer surface in contact with a piezoelectric actuator provided to move the movable wall while changing the volume of the pumping chamber by means of the piezoelectric actuator, characterized in that the pump is placed in the ironing appliance in such a way that the outlet of the pumping chamber is located at a higher level than the inlet in a normal position for operating the appliance.

"Normal position for operating the appliance" is understood to mean a position of the appliance corresponding to a customary and preferred use of said appliance. In the case of a clothing iron with a heating sole, the normal operating position thus corresponds to the position in which the clothing iron is resting on its sole.

According to another characteristic of the invention, the pump comprises a support that includes the inlet and outlet of the pumping chamber, and the movable wall of the pumping chamber is aligned vertically.

According to still another characteristic of the invention, the inlet and the outlet pierce the support, the latter element comprising a face interior to the pumping chamber that includes a channel extending between the inlet and the outlet.

According to still another characteristic of the invention, the pumping chamber has a circular shape, wherein the inlet emerges near the center of said pumping chamber and the outlet is located near the periphery of said pumping chamber.

According to another characteristic of the invention, the pump comprises a film sandwiched between the support and a base plate, the latter comprising a delivery line and a discharge line that communicate with the inlet and the outlet of the pumping chamber, respectively, the film comprising valves opposite the inlet and the outlet.

According to another characteristic of the invention, the film is made of silicone and the valves are formed by making an arc-shaped cut in the film.

According to another characteristic of the invention, the cut is in the shape of an arc whose endpoints form an angle less than 180°.

According to another characteristic of the invention, the appliance is a clothing iron comprising a receptacle and a vaporization chamber supplied with water from the receptacle by means of the pump.

According to another characteristic of the invention, the pump is connected to a water reservoir placed downstream from the pump.

According to still another characteristic of the invention, a drip valve is interposed between the water reservoir and the vaporization chamber.

According to another characteristic of the invention, the pump is positioned vertically in the back of the iron, outside of the receptacle.

According to another characteristic of the invention, the pump is positioned level with the bottom of the receptacle.

BRIEF DESCRIPTION OF THE DRAWINGS

The objects, aspects, and advantages of the present invention will emerge more clearly from the following description of an illustrative embodiment of the invention provided as a nonlimiting example, with reference to the appended drawings in which.

DETAILED DESCRIPTION OF THE INVENTION

Only the elements needed for understanding the invention have been shown. To make the drawings easier to read, the same elements have the same reference numbers from figure to figure.

Figure 1:
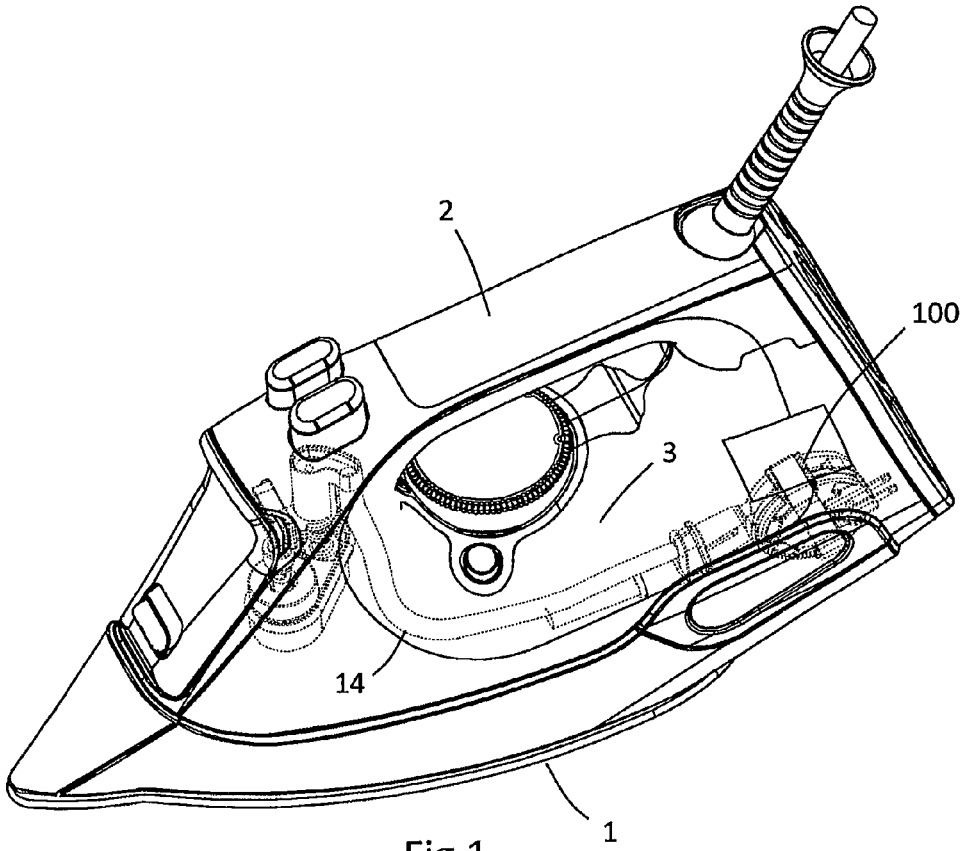
FIG. 1 is a perspective view of a clothing iron according to a particular embodiment of the invention.

FIG. 1 shows a clothing iron comprising a pressing sole 1 surmounted by a body equipped with a handle 2, the body enclosing a water receptacle 3 and a piezoelectric pump 100 supplied by the receptacle 3, the operation of which is controlled by means of a trigger (not visible in the figures) provided under the handle 2.

Figure 2:
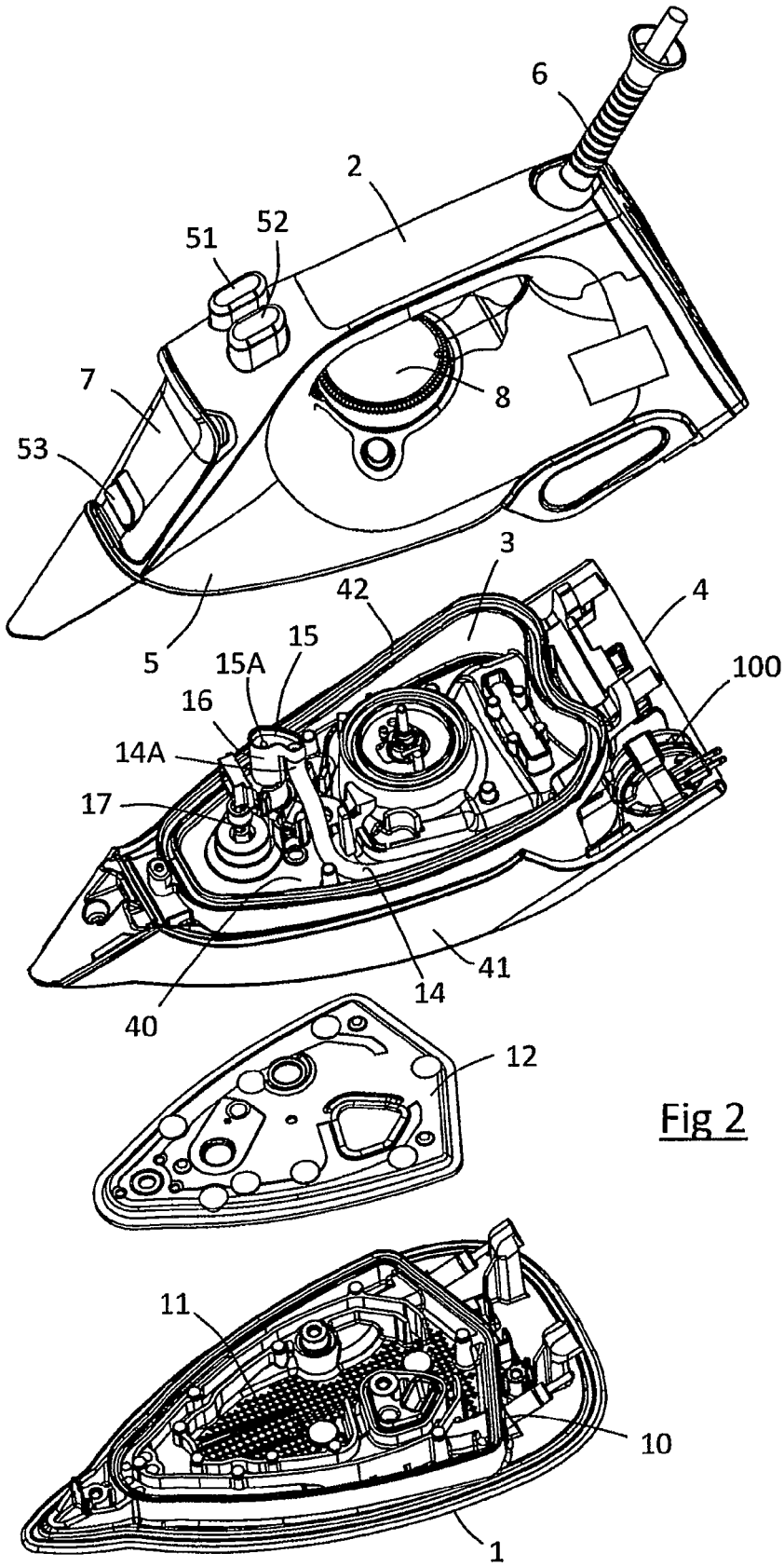
FIG. 2 is a partially exploded perspective view of the clothing iron of FIG. 1.

According to FIG. 2 illustrating the iron in exploded view, the sole 1 of the iron thermically contacts a heating element 10 that integrates, in a manner known per se, a vaporization chamber 11 for generating steam, wherein the vaporization chamber is closed by a lid 12 and connected to a steam dispensing circuit that includes steam outlet holes bored in the sole 1.

In order to restrict the heat from being conducted to the iron handle 2, the heating element 10 is surmounted by a heat screen 4 that comprises a center portion 40 defining the bottom of the receptacle 3 and a peripheral portion constituting a protective skirt 41 that extends under the bottom of the receptacle 3 and matches the contour of the sole 1 in such a way that it laterally borders the heating element 10.

The center portion 40 of the heat screen 4 is bordered by a groove 42 in which a wall (not visible in the figures) defining the top portion of the receptacle 3 engages, said wall being borne by a top casing element 5 attached onto the heat screen 4. An example of such a two-part receptacle assembly is described in more detail in French patent application #2 770 856 filed by the applicant.

The top casing element 5 comprises the handle 2 for gripping the iron and supports a cord guiding mechanism 6 for aligning the electric cord of the iron. The casing element 5 further comprises a hatch 7 for accessing a fill hole for the receptacle 3, a knob 8 for adjusting a thermostat associated with the heating element 10, and buttons 51, 52 for actuating manual pumps for discharging a spray of water from a nozzle 53 placed on the front face of the iron or for the instantaneous discharge of a volume of water into the vaporization chamber 11 for generating extra steam, respectively.

Figure 3:
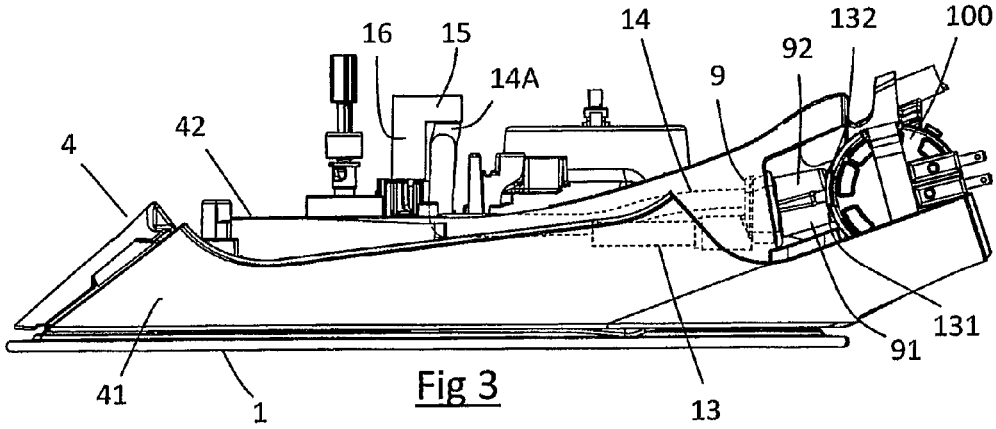
FIG. 3 is a side view of the clothing iron of FIG. 1 with its top portion removed in order to reveal the elements placed in the interior of the receptacle.
Figure 4:
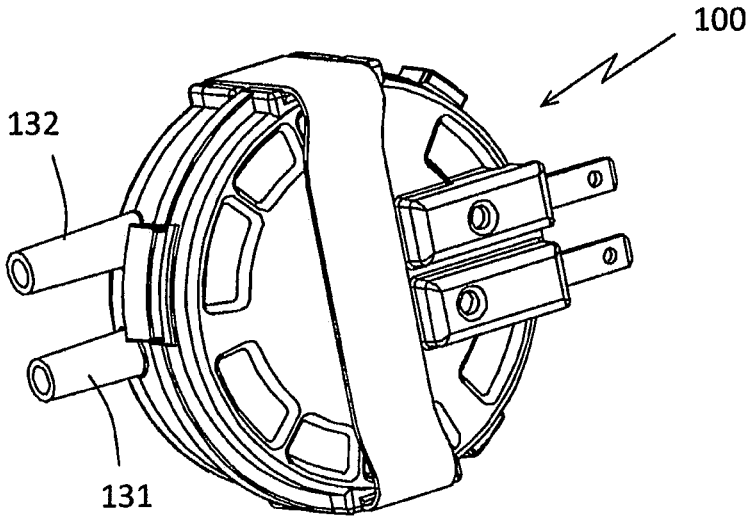
FIG. 4 is a perspective view of the piezoelectric pump of the iron of FIG. 1.

According to FIGS. 3 and 4, the heat screen 4 comprises a back portion that supports the piezoelectric pump 100, wherein the latter element is placed on the outside of the receptacle 3, roughly level with the bottom of the receptacle, and comprises a delivery line 131 and a discharge line 132 connected to a first coupling sleeve 91 and a second coupling sleeve 92, respectively, of a rubber tube gland 9 inserted through a back wall of the receptacle 3.

In the interior of the receptacle 3, the first coupling sleeve 91 is connected to a tube 13 extending to near the bottom of the receptacle, said tube 13 containing a filter that prevents limestone particles from being sucked through the pump 100. The second sleeve 92 in turn is connected to a line 14 that extends the length of the receptacle 3 and comprises an end 14A emerging vertically in the front part of the heat screen 4 at the level of the bottom of a cistern 15 borne by the top end of a water reservoir 16, said cistern 15 being open at its top end such that a spillway for allowing the return of superfluous water to the receptacle 3 is formed.

The water reservoir 16 extends vertically to a height such that the bottom of the cistern 15 is located ca. 4 cm above the level of the bottom of the receptacle 3, the cistern 15 comprising an orifice 15A that communicates with a supply circuit for a drip valve 17 placed in the front part of the iron and emerging above the vaporization chamber 11 in a standard manner.

In this manner, the water fed to the cistern 15 by the pump 100 can then flow by gravity through the orifice 15A in the water reservoir 16 in such a way as to supply the drip valve 17 for the generation of steam. The use of such a water reservoir 16 thus has the advantage of making it possible to obtain a constant water column height upstream from the drip valve 17, enabling the generation of a substantial steam flow of around 40 to 50 g/min, regardless of the fill level of the receptacle 3.

The flow rate of the piezoelectric pump 100 is preferably intended to be greater than the flow rate needed to generate 50 g/min of steam so that the generation of steam is not limited by the flow rate of the pump 100, the superfluous water fed by the pump 100 to the water reservoir 16 emptying into the receptacle via the top opening of the cistern 15. By way of an example, the mean flow rate of the bioelectric [sic] pump illustrated in the figures is around 100 ml/min.

In a manner known per se, the opening of the drip valve 17 is automatically controlled by a mechanical control system (not shown in the figures) relative to the temperature of the thermostat of the heating element 10 such that the amount of steam generated by the iron is automatically adjusted relative to the temperature, or to the type of fabric, selected by the user by means of the knob 8.

Figure 5:
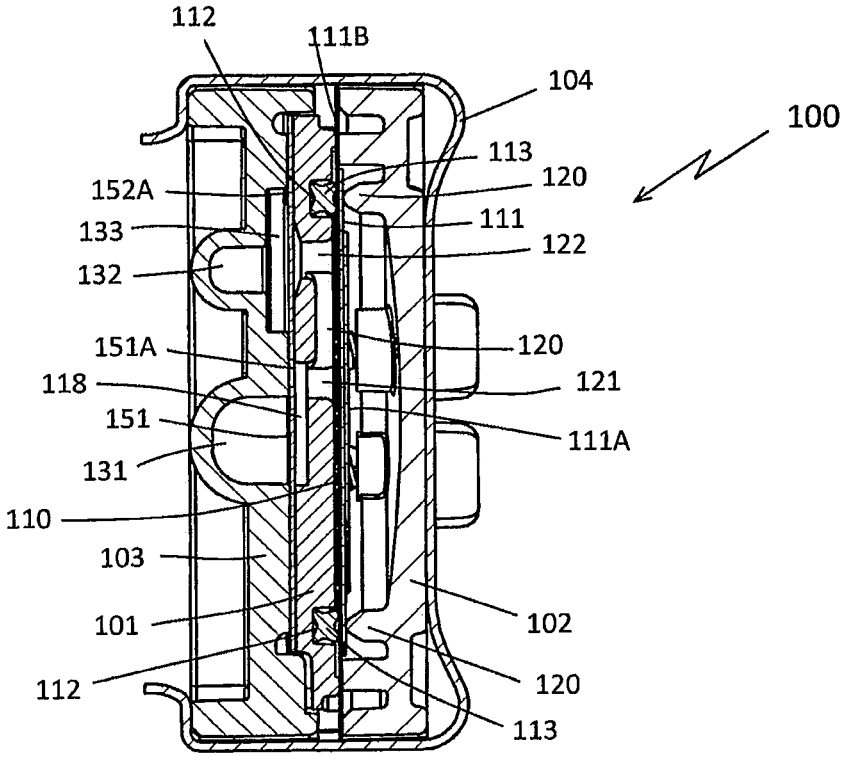
FIG. 5 is a cutaway view of the pump of FIG. 4.
Figure 6:
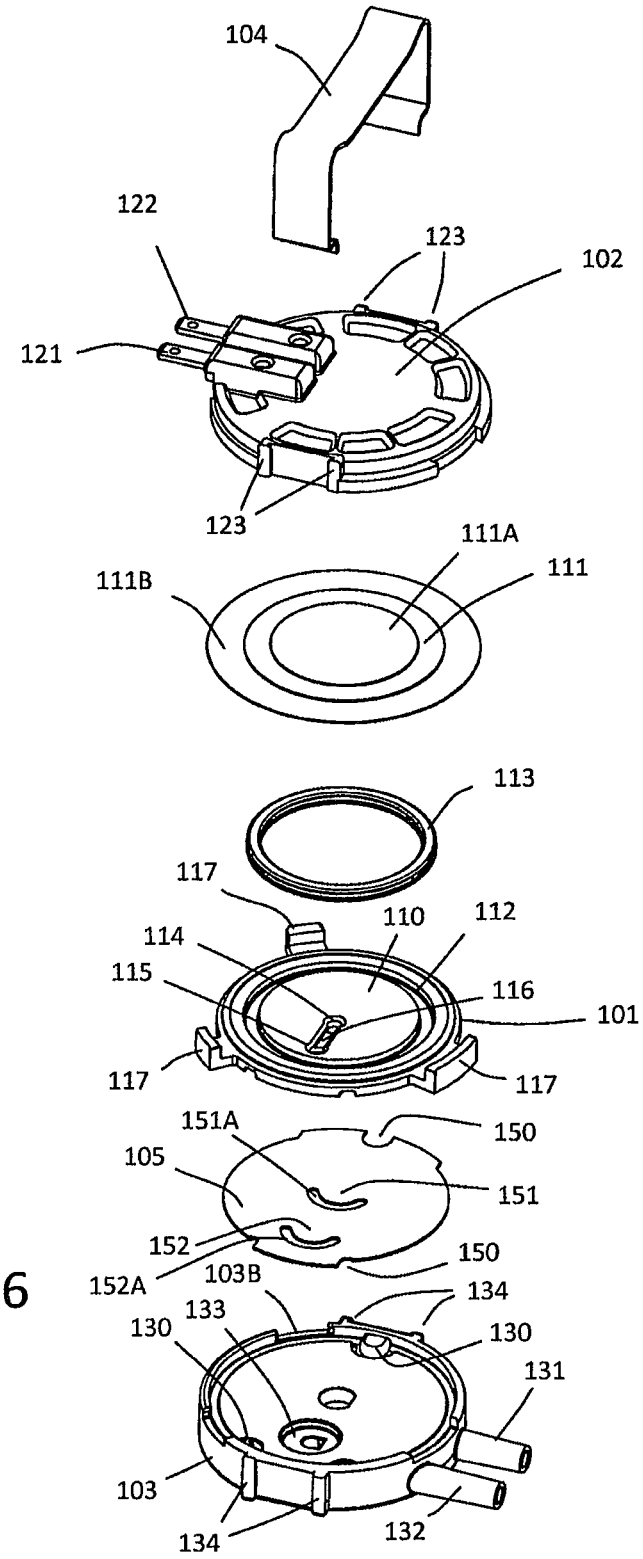
FIG. 6 is an exploded perspective view of the pump of FIG. 4.

FIGS. 4-6 are detailed illustrations of the piezoelectric pump equipping the clothing iron of FIGS. 1-3.

According to FIGS. 5 and 6, the piezoelectric pump 100 comprises a pumping chamber 110 that is defined by a support 101 and a movable wall 111 disposed face to face, the support 101 having a circular central zone bordered by a channel 112 that houses a gasket 113 on which the movable wall 111 will rest. The movable wall advantageously consists of a brass membrane 111 that comprises an outer surface oriented to the exterior of the pumping chamber 110, on which is fastened a ceramic piezoelectric actuator 111A.

The membrane 111 is held against the gasket 113 by means of a lid 102 fastened onto the support 101, said lid 102 comprising a raised circular rib 120 that presses against the outer surface of the membrane 111 opposite the gasket 113. The support 101 also houses a base plate 103 on the other side from the lid 102, said base plate 103 supporting the delivery 131 and discharge 132 lines of the pump.

The support 101, the lid 102, and the base plate 103 are advantageously made of plastic reinforced with glass fibers, such as a polyarylamide with 30% glass fiber reinforcement, and are held together under stress by means of an elastic clip 104 in the form of a springy metal band that engages between guide ribs 123, 124 formed on the periphery of the lid 102 and of the base plate 103, respectively.

The lid 102 comprises electric terminals 121, 122 that are electrically connected to the membrane 111 and to the piezoelectric actuator 111A and powered, in a manner known per se, by an a.c. voltage bringing about a periodic deformation of the piezoelectric actuator 111A and of the flexible membrane 111 in the direction for increasing and then decreasing the volume of the pumping chamber 110. An example of a circuit for supplying power to the piezoelectric actuator is described in French patent application #08 01706.

In order to ensure electric insulation between the parts of the pump 100 subjected to an electric potential and the liquid contained in the pumping chamber 110, the bottom face of the membrane 111 is coated with an insulating film 111B consisting of three polyester films held together by means of an adhesive, as described in more detail in French patent application #08 03520.

More particularly according to the invention, the delivery 131 and discharge 132 lines emerge opposite an inlet 114 and an outlet 115 piercing the support 101, respectively, and the pump 100 is placed vertically in the iron in such a way that the outlet 115 of the pumping chamber 110 is located at a higher level than the inlet 114 when the iron is in a normal operating position, i.e., resting on its sole 1.

The inlet 114 is preferably placed substantially in the center of the pumping chamber 110 in such a way that it is located opposite the maximum clearance zone of the membrane 111, where the depression is greatest. The outlet 115 in turn is preferably placed near the periphery of the pumping chamber 110, the pump 100 being placed vertically in the iron such that the outlet 115 is located substantially at the top of the pumping chamber 110 when the iron is resting flat on its sole 1.

In order to facilitate the expulsion of any air bubbles present in the pumping chamber, the dead volume of the pumping chamber 110 is essentially reduced to a groove 116 with a depth of around 1 mm extending between the inlet 114 and the outlet 115 on the face of the support 101 opposite the lid 102, said groove 116 enabling the channeling of the air bubbles towards the outlet.

According to FIG. 6, the correct positioning of the lid 102 and of the base plate 103 on the support 101 is ensured by three centering tabs 117 borne by the support 101, said centering tabs 117 cooperating with the periphery of the lid 102 and with notches 1036 on the periphery of the base plate 103.

A silicone film 105 is interposed between the support 101 and the base plate 103 to form valves 151, 152 opposite the inlet 114 and the outlet 115, the positioning of the film 105 on the base plate 103 being ensured by cut-outs 150 formed on the periphery of the film, wherein said cut-outs 150 engage around bosses 130 borne by the base plate 103.

The valve 152 opposite the outlet 115 is preferably formed by an arc-shaped cut 152A forming a flexible operculum opposite a circular recess 133 formed in the base plate 103, said valve 152 opening in the recess 133 when water is compressed in the pumping chamber 110 and closing when the piezoelectric actuator 111A bends in the direction for increasing the volume of the pumping chamber 110.

Such a construction combined with a water reservoir 16 disposed downstream from the pump 100 has the advantage of enabling the creation a one-way valve in a very simple manner, wherein the presence of water in the line 14 creates a pressure downstream from the valve 152 that generates a check force proportional to the height of the water column tending to keep said valve 152 closed. Such a characteristic is particularly interesting because it prevents the water downstream from the valve 152 from flowing by gravity through the pump 100 and the receptacle 3 when the pump 100 is turned off.

The valve 151 opposite the inlet 114 is likewise formed by an arc-shaped cut 151A forming a flexible operculum opposite a circular recess 118 formed in the support 101, said valve 151 closing when the water in the pumping chamber 110 is compressed by the membrane 111 and opening when the piezoelectric actuator 111A bends in the direction for increasing the volume of the pumping chamber 110.

The vertical position of the pump 100 in the iron, with the outlet 115 located above the inlet 114, has the advantage of enabling the formation of a water column downstream from the valve 152, thus creating a pressure that generates a check force tending to keep said valve 152 closed. Such a characteristic makes it possible to keep the valve 152 closed when the pump 100 is turned off, without having to resort to a valve spring.

The arc-shaped cuts 151A, 152A preferably extend angularly less than 180° and are preferably aligned in the same direction so that a substantial width of material extends between said cuts 151A, 152A. Such a characteristic makes it possible to achieve good stability of the film 105 right next to said cuts 151A, 152A, significantly reducing the risk of the valves 151, 152 bending in the direction of opening when the film 105 is compressed between the support 101 and the base plate 103.

The clothing iron thus configured has the advantage of possessing an efficient piezoelectric pump capable of expelling any air bubbles that may enter the pumping chamber, as the air bubbles have the natural tendency to be driven upwards towards the outlet by the water coming from the receptacle. An iron capable of generating a large amount of steam for high pressing efficiency and possessing stable performance characteristics over time is thus obtained.

Obviously the invention is in no way limited to the embodiment described and illustrated herein, which was merely provided as an example. Modifications are still possible, particularly in terms of the constitution of the various elements or by substituting technological equivalents, without exceeding the scope of protection of the invention in any way.

Hence the shape of the pumping chamber or the means of assembling the pump elements could be changed in a variant of embodiment of the invention.

The invention claimed is:

1. Ironing appliance comprising a pump that includes a pumping chamber with an inlet and an outlet, said pumping chamber including a movable wall that comprises an outer surface contacting a piezoelectric actuator provided for moving said movable wall while changing the volume of the pumping chamber by means of said piezoelectric actuator, wherein said pump is placed in the ironing appliance such that the outlet of the pumping chamber is located at a higher level than the inlet in a normal position for operating the appliance.

2. Ironing appliance as in claim 1, wherein the pump comprises a support including the inlet and the outlet of the pumping chamber and further wherein the movable wall of the pumping chamber is aligned vertically.

3. Ironing appliance as in claim 2, wherein the inlet and the outlet pierce the support and further wherein the support comprises a face interior to the pumping chamber that includes a groove extending between the inlet and the outlet.

4. Ironing appliance as in claim 2, wherein the pumping chamber has a circular shape and further wherein the inlet opens near the center of the pumping chamber; the outlet being located near the periphery of the pumping chamber.

5. Ironing appliance as in claim 1, wherein said pump comprises a film sandwiched between said support and a base plate, said base plate comprising a delivery line and a discharge line communicating with the inlet and with the outlet, respectively, said film comprising valves opposite the inlet and the outlet.

6. Ironing appliance as in claim 5, wherein the film is made of silicone and further wherein the valves are formed by making an arc-shaped cut in said film.

7. Ironing appliance as in claim 6, wherein said cut has the shape of an arc whose endpoints form an angle less than 180°.

8. Ironing appliance as in claim 1, wherein said appliance is a clothing iron comprising a receptacle and a vaporization chamber supplied with water from the receptacle by means of said pump.

9. Ironing appliance as in claim 8, wherein the pump is connected to a water reservoir disposed downstream from said pump.

10. Ironing appliance as in claim 9, wherein a drip valve is interposed between said water reservoir and the vaporization chamber.

11. Ironing appliance as in claim 8, wherein the pump is placed vertically in a back portion of the iron, on the outside of the receptacle.

12. Ironing appliance as in claim 8, wherein the pump is positioned level with a bottom portion of the receptacle.

* * * * *

UNITED STATES PATENT AND TRADEMARK OFFICE

CERTIFICATE OF CORRECTION

PATENT NO. : 8,484,869 B2
APPLICATION NO. : 13/139347
DATED : July 16, 2013
INVENTOR(S) : Andrea Lukas et al.

It is certified that error appears in the above-identified patent and that said Letters Patent is hereby corrected as shown below:

On the Title Page, Column 2, Item (57) Abstract, Line 3, delete “moveable” and insert -- movable --

Signed and Sealed this
Twenty-fourth Day of December, 2013

Margaret A. Focarino

Margaret A. Focarino
*Commissioner for Patents of the United States Patent and Trademark Office*

UNITED STATES PATENT AND TRADEMARK OFFICE

CERTIFICATE OF CORRECTION

PATENT NO. : 8,484,869 B2
APPLICATION NO. : 13/139347
DATED : July 16, 2013
INVENTOR(S) : Lukas et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 196 days.

Signed and Sealed this
Eighth Day of September, 2015

Michelle K. Lee

Michelle K. Lee
*Director of the United States Patent and Trademark Office*